United States Patent [19]

Esslinger

[11] Patent Number: 4,785,742

[45] Date of Patent: Nov. 22, 1988

[54] WORKTABLE WITH WORK SURFACE AND TABLE MOUNT

[75] Inventor: Hartmut H. Esslinger, Grenzweg, Fed. Rep. of Germany

[73] Assignee: Konig & Neurath Kommanditgesellschaft, Fed. Rep. of Germany

[21] Appl. No.: 465,444

[22] Filed: Feb. 10, 1983

[51] Int. Cl.[4] ..... A47F 5/12

[52] U.S. Cl. ..... 108/6; 108/101; 108/147

[58] Field of Search ..... 108/6–10, 108/101, 147; 211/189

[56] References Cited

U.S. PATENT DOCUMENTS

| | | | |
|---|---|---|---|
| 1,420,404 | 6/1922 | Beaver | 108/8 |
| 3,506,323 | 4/1970 | Leprince | 312/209 |
| 3,883,202 | 5/1975 | Konig | 312/223 |
| 4,094,256 | 6/1978 | Holper et al. | 312/194 X |
| 4,433,884 | 2/1984 | Edwards et al. | 312/250 X |

FOREIGN PATENT DOCUMENTS

| | | |
|---|---|---|
| 2743073 | 3/1979 | Fed. Rep. of Germany . |
| 8003214 | 5/1980 | Fed. Rep. of Germany . |
| 8025650 | 1/1981 | Fed. Rep. of Germany . |
| 8108834 | 8/1981 | Fed. Rep. of Germany . |
| 2846223 | 8/1982 | Fed. Rep. of Germany . |

*Primary Examiner*—Joseph Falk

*Attorney, Agent, or Firm*—Thomas W. Speckman

[57] ABSTRACT

A worktable with a working surface which can be adjusted in height and/or inclination, which is connected with a table mount by means of an adjustment mechanism. A worktable which can be constructed of individual parts and which can be expanded in width and joined to modular systems is provided by the table mount being a base frame with two supporting columns arranged in the interval of table width and two preferably U-shaped leg members having a central joining portion, a base leg and supporting leg whereby the supporting columns are firmly connected with each other by at least one transverse connecting member and said central joining portion of said leg members adapted to be connected to said supporting columns of said base frame and that said adjustment mechanisms are mounted on the underside of said work surface between said support legs of said leg members and adapted to be connected to said supporting legs.

17 Claims, 3 Drawing Sheets

WORKTABLE WITH WORK SURFACE AND TABLE MOUNT

BACKGROUND OF THE INVENTION

This invention relates to a worktable with a working surface adjustable in height and/or inclination, which is connected with a table mount by means of an adjustment mechanism.

There are worktables of this general type having different designs. In a first class of worktables, the worktable held in horizontal position can be adjusted only in height. This group includes worktables as they are described, for example, in German Patent Application DE-AS No. 27 43 073 and German Utility Model DE-GM No. 80 03 214.

In a second class of worktables, the working surface can be changed only in inclination. Examples of this second group of worktables, for example, are shown in German Utility Models DE-GM No. 80 25 650 and DE-GM No. 81 08 834.

In a third class of worktables, the working surface can be changed in height as well as in inclination, as shown, for example, in German Patent Application DE-OS No. 28 46 223.

Complicated design is common to all these disclosed worktables. The prior worktables are completely assembled in the manufacturing plant and brought to the place of use as a unit. In addition, worktables must be provided in different table widths, which may not be directly expanded or connected with other office furniture or with a modular system.

SUMMARY OF THE INVENTION

It is an object of the present invention to provide worktables having working surfaces adjustable in height and/or inclination and connected to a table mount, the units being composed of individual constructional parts which are designed with different adjustment mechanisms and can be combined with other furniture into a unit or modular system.

This is achieved according to the invention by providing a table mount comprising an inverted U-shape base frame with two supporting columns arranged with their spacing corresponding to the table width and firmly connected with each other by means of at least one connecting member and two, preferably sidewise U-shaped, leg members comprising a central joining portion, a base leg and a supporting leg, the joining portion of the leg members detachably fastened to the supporting columns of the frame. Adjustment mechanisms are mounted on the underside of the working surface adjacent the supporting leg of the leg members and are designed as intermediate units which can be connected to the supporting legs of the leg members.

The worktable and table mount of this invention can be stored and transported in a disassembled and flat state. Assembly at the use site is very simple. The leg members and the adjustment mechanisms designed as intermediate units are usable for worktables of different widths, whereby different adjustment mechanisms can also be used, which selectively give a work table of the first, second or third group. The base frame allows different widths of the worktable. The sidewise U-shaped leg members provide an optimum freedom of movement for the person sitting at the worktable.

To achieve good stability of the worktable, it is preferred, according to one embodiment, that the vertical dimension of the base leg and of the supporting leg continuously increases from their free ends to the central joining portion.

According to another embodiment, it is provided that the leg members are designed as hollow shapes provided with fastening flanges, open to the upper side of the supporting leg. Then not only the weight of the work table is reduced, but also parts of the adjustment mechanisms, which project out of or are conducted out of the intermediate units, can be introduced into the hollow shapes of the leg members.

The provision of electrical cables or other supply lines to equipment on the worktable is facilitated according to one embodiment by the supporting columns of the base frame being U-profiles open toward the outside, which are provided in both legs with fastening holes and can be covered by a covering plate, and that the transverse connecting member joining the upper ends of the supporting columns with each other is a U-profile, open toward the top, which can be covered by means of one or several cover plate(s). The cover plates cover not only the cables laid in the U-profiles or the like, but they close off the base frame toward the outside and upward flush with the leg members or the work surface in normal position.

According to one advantageous design, parts of the cover plates are provided with plug receptacles for plugs of additional mechanisms such as shelves, illumination mechanisms or the like. The additional mechanisms can thus be mounted without impairing the form of the worktable, whereby their position can also be easily changed by the position of the cover plates with the plug receptacles on the transverse connecting member. The cover plates are preferably made available in set dimensions, so that a stepwise adjustment of the cover plates is possible with the plug receptacles and plain cover plates so that the transverse connecting member can be completely covered.

In order that the working height of the worktable can be adjusted even below the normally conventional working height, the design provides that the cover plates of the transverse connecting member are arranged at the normal working height and that the support legs of the leg members end at a given interval below these cover plates, whereby the interval is determined by the lowest adjustment height of the work surface and the height of the fully lowered adjustment mechanisms designed as an intermediate unit.

The appearance of the worktable is improved by the adjustment mechanisms being fully covered by means of a bellows and the operating elements being arranged on the under side of the working surface between the adjustment mechanisms.

According to one embodiment, it is provided that the base frame is designed as an adjustment wall, which preferably is provided with suspension rails on the front and/or back side of the vertical edges, then additional shelves or other additional device can be suspended on the suspension rails. It is provided according to a preferred embodiment that the adjustment wall extends above the working table adjusted in highest position by a given amount and on its upper edge bears a horizontal shelf directed toward the working surface. This shelf then does not impair the adjustment of the working surface.

According to another design, the base frame can be utilized as a space divider, if the design is selected in such a way that the adjustment wall has a height at least double the working height and is provided on at least one side at the working height with a removable, horizontally directed cover plate which covers a U-shaped transverse connecting member open on this side. It is also preferred that the vertical narrow sides of the adjustment walls are provided with cover plates up to working height, which cover U-shaped supporting columns open toward these sides, then covered cable placement is also made possible in the case of a base frame designed as adjustment wall.

If the base frames and the working tables are designed to different table widths, matching each other, then it is easy to build up working tables of different widths with uniform leg members and adjustment mechanisms.

BRIEF DESCRIPTION OF THE DRAWINGS

The invention will be explained in more detail on the basis of specific design examples shown in the drawings wherein.

DESCRIPTION OF PREFERRED EMBODIMENTS

Figure 1:
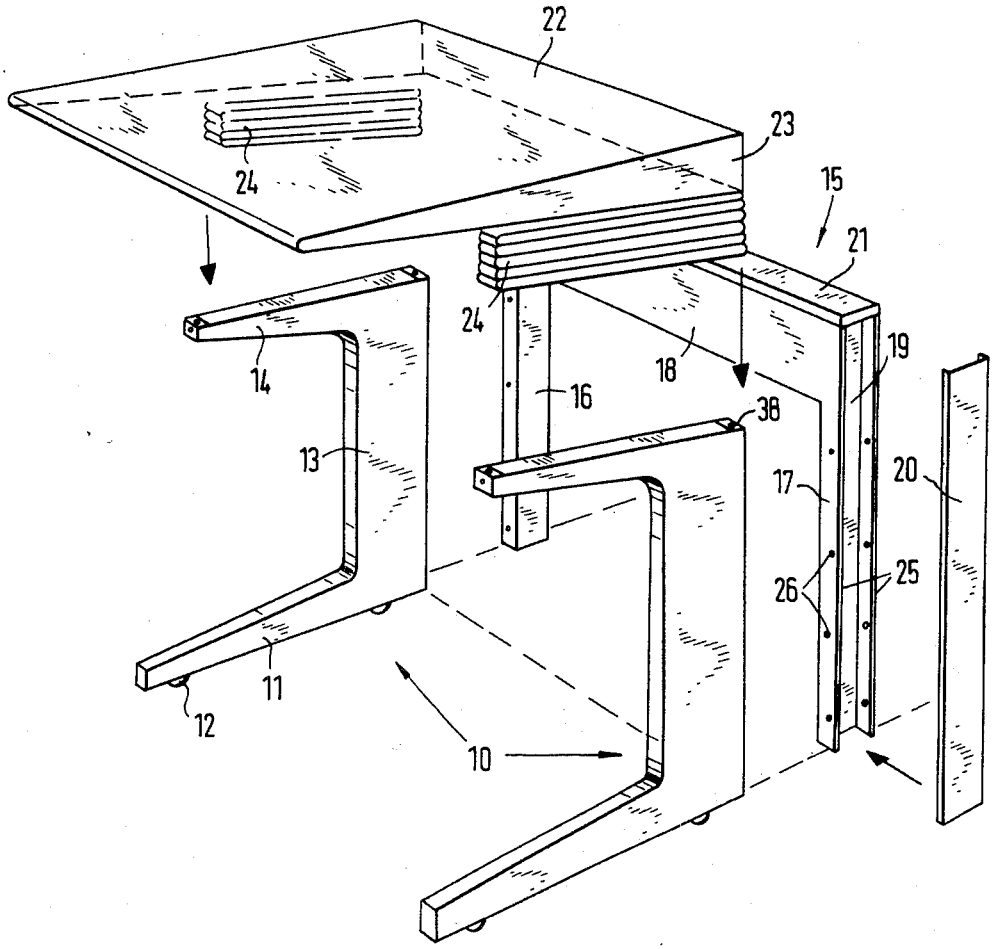
FIG. 1 shows a perspective exploded view of the component parts for one working table according to the invention.

FIG. 1 shows the parts required for the working table according to the invention in an exploded assembly view. Base frame 15 is in the shape of an inverted U frame in the design example and shows the two supporting columns 16 and 17 spaced at the interval of the desired table width and solidly connected to each other on their upper ends by transverse connecting member 18. This base frame, however, can also have several supporting columns between supporting columns 16 and 17 or the space between the connecting members can be completely closed. Supporting columns 16 and 17 are designed as U-profiles open toward the outside and are covered by cover plates 20. Opening 19 formed between side legs 25 of supporting columns 16 and 17 can accommodate electrical cables or the like, which lead to additional devices, which are arranged on or above the working table. It is advantageous if the transverse connecting members 18 are designed as U-profiles open toward the top and can be covered by means of an access providing cover plate 21 or with several partial covering plates subdivided in given dimensions.

The table mount is provided by two U-shaped leg members 10, each of which comprise a central joining portion 13, a base leg 11 and supporting leg 14. These leg members, designed as hollow shapes open toward the outside, can be connected by central joining portion 13 with a side leg of supporting columns 16 and 17. Since both side legs 25 of supporting columns 16 and 17 are provided with fastening holes 26, the base frame 15 can be connected on one side or both sides with leg members 10 and in this way a single or double working table may be constructed. In the case of a single working table, several furniture parts can be connected to the free side of base frame 15. The base legs 11 of leg members 10 may be provided on the under side with partially projecting small rollers 12, so that the worktable may be easily moved. Instead of the small rollers 12, however, it is also possible to mount conventional feet or the like.

The open upper side of leg members 10 are provided with fastening flanges 38, so that the adjustment mechanisms designed as intermediate units 24 can be connected with leg members 10. Adjustment mechanisms 24 form completely covered units by means of a bellows and provide connection between leg members 10 and working table 22. Adjustment mechanisms 24 can be designed in such a way that they permit only a height adjustment or only an inclination adjustment or both adjustments. Thus the three different classes of worktables can be obtained with different adjustment mechanisms 24, with the other parts such as the base frame 15, the leg members 10 and the working table 22 being the same. Adjustment mechanisms 24 are preferably mounted on the underside of the worktable 22, whereby the actuating elements of the adjustment mechanisms are conducted out on the sides facing each other and are connected with operating elements, which are arranged between the adjustment mechanisms on the underside of worktable 22 and are accessible and can be operated and serviced from the front edge of worktable 22. Suitable adjustment mechanisms are taught in German Patent DE-PS No. 2846223 and in Applicant's pending Germany patent application P No. 32 37 252.

Worktable 22 extends beyond supporting legs 14 of the members 10, which are shorter than base legs 11 of leg members 10. This achieves a sufficient stability for the working table. Central joining portions 13 of leg members 10 are wider than supporting legs 14 and base legs 11, but they still allow sufficient freedom of movement at both sides for the legs of persons sitting at the working table. If this freedom of movement at the sides is dispensed with, especially in the case of wide working tables, then the leg members can also be designed as flat plates. Working table 22 can also be provided with side plates 23, the height of which continuously increase from the front edge to the rear edge of the worktable 22. Adjustment mechanisms 24 may then be arranged directly behind side walls 23 and the bellows can be mounted flush with leg members 10. Moreover, a certain inclination of the working surface 22 can be given as its normal position.

Figure 2:
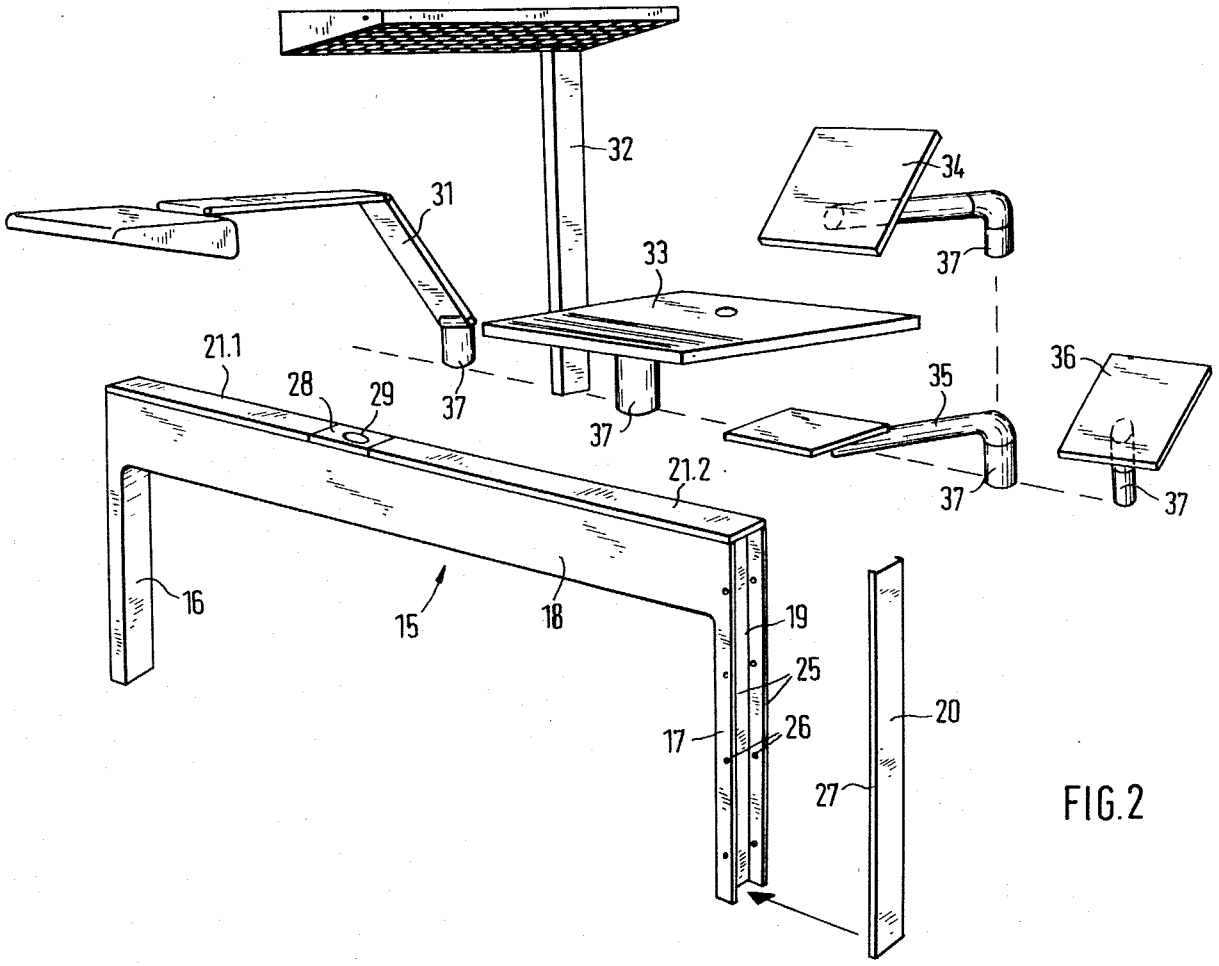
FIG. 2 shows different additional mechanisms which can be connected with a frame-like base frame.

As shown in FIG. 2, base frames 15 of different widths can be provided to accommodate working tables with different table widths. The same leg members 10 and the same adjustment mechanisms 24 can be used mounted on a correspondingly wide worktable 22. Covering of connecting member 18 is accomplished with partial cover plates 21.1 and 21.2, as well as with partial cover plate 28, which shows plug receptacle 29, which extends into the interior of connecting member 18. Suitably designed mating plug 37 of different devices can be inserted into plug receptacle 29. Additional devices designed in different fashions as shelves 33, 34, 35 and 36 or as lights 31 or 32 can be connected with the working table, without changing its design. The partial covering plate 28 with plug receptacle 29 can be mounted at different places along connecting member 18 and in this way the position of the additional devices can be changed. Also, several partial cover plates 28 with plug receptacles 29 can be connected to connecting member 18, so that several additional devices can be mounted on the base frame. Open areas of connecting member 18 may be covered with partial cover plates. Preferably, a grid division of the partial cover plates is selected which makes possible a stepwise adjustment of the additional devices. Moreover, differently shaped plug receptacles can be provided for differently designed additional devices and may be provided with further internal wiring of electrical cables and wires.

Figure 3:
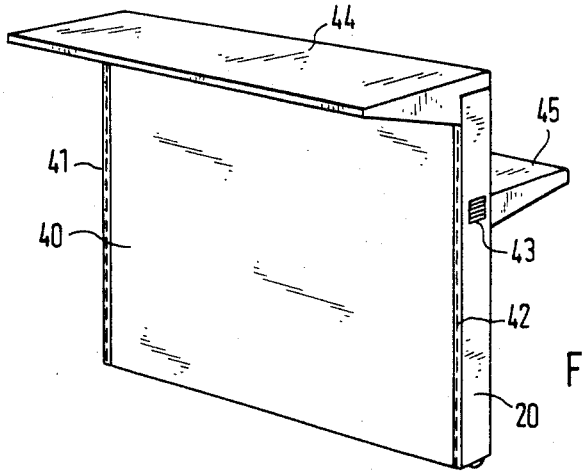
FIG. 3 shows one embodiment of a design of a base frame designed as an adjustable wall.

FIG. 3 shows a base unit 40, designed as an adjustment wall. This completely closed base unit 40 is provided with hanger moldings 41 and 42 on the vertical edges of the front and/or back side, which also can be used for mounting leg members 10. Since base unit 40 has a height which is greater than the highest working height of the worktable, it can be closed above with a horizontal shelf 44 facing work surface 22 of the worktable. Another shelf 45, which is provided with a mounting hook, can be mounted in the slot of the hanger moldings on the back side. The narrow ends of base unit 40 are covered by means of cover plates 20, which extend at least up to the normal working height of the working surface and are provided with grip elements 43. In turn, cover plates 20 cover the supporting columns of the base unit 40 which are open toward the outside, the base unit being covered with enclosure panels on the front and the rear side. The enclosure panels may be covered with different materials.

Figure 4:
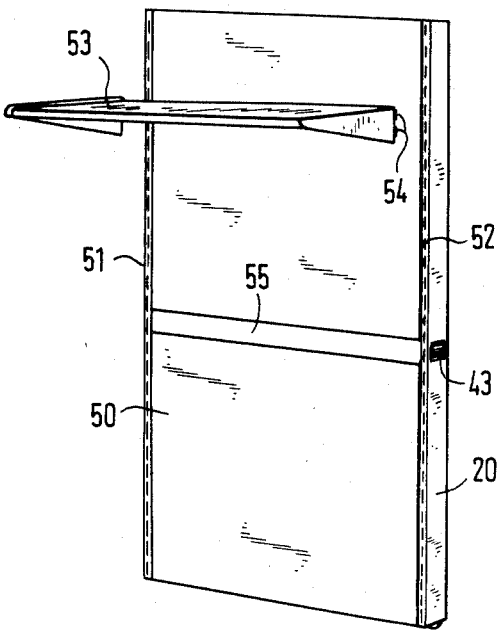
FIG. 4 shows another embodiment of a design of a base frame designed as an adjustable wall and room divider.

FIG. 4 shows base unit 50 can also be designed as an adjustable wall and room divider. The height may be greater than double the working height. The base unit 50 bears hanger moldings 51 and 52 on the vertical edges on the front and rear sides. Cover plates 20 cover the supporting columns of base unit 50 up to the working table height. Cover plate 55 covers a U-shaped transverse member toward the front above the work surface, so that cables conducted through the side supporting columns or the like can be conducted further along the back of the work surface to the additional devices on the worktable. Also, the back side of the base unit 50 can have a horizontal cover plate 55 at the same height, which covers an additional horizontal opening in the transverse member. Thus, worktables made of leg members 10, adjustment mechanisms 24 and working surfaces 22 can be mounted to the hanger moldings on both sides of base unit 50. Shelves 53 provided with suspension hooks 54 can also be mounted in the areas of the suspension rails 51 and 52 which remain free.

I claim:

1. A worktable with a work surface adjustable in inclination, which is connected to a table mount by means of an adjustment mechanism, characterized by the fact that said table mount comprises a unitary base frame (15) having two supporting columns (16, 17) spaced at a distance from each other corresponding to the width of said worktable, said supporting columns (16, 17) firmly connected to each other by means of at least one transverse connecting member (18) and two unitary leg members (10) each comprising a central joining portion (13), with a base leg (11) and a supporting leg (14) extending from said central joining portion, said central joining portions (13) of said unitary leg members (10) detachably fastened to said supporting columns (16, 17) of said unitary base frame (15) and said adjustment mechanisms (24) mounted on the underside of said work surface (22) adjacent said supporting legs (14) of said leg members (10) and connected to said supporting legs (14) of said leg members (10).

2. A work table having a height adjustable work surface, said worktable comprising:

a unitary base frame (15) having two supporting columns (16, 17) spaced at a distance corresponding to the width of said worktable, said supporting columns (16, 17) firmly connected to each other by at least one transverse connecting member (18);

two one-piece leg members (10), each said leg member (10) being ⊃-shaped having a vertical joining portion (13) detachably fastened at its rear side to one of said supporting columns (16, 17) and having a base leg (11) extending from the lower end of its front side a distance about the depth of a worktable surface (22) and a support leg (14) extending from the upper end of its front side a distance less than said depth of said worktable surface;

two adjustment mechanism means (24), mounted on the underside of said worktable surface (22) and connectible to the top of each said support legs (14) whereby said worktable surface (22) is height adjustable.

3. A worktable according to claim 2, wherein the vertical dimension of said base legs (11) and of said supporting legs (14) increases continuously from the free ends to said central joining portion (13).

4. A worktable according to claim 2, wherein said one-piece leg members (10) are hollow in shape and are provided with fastening flanges (38) at the open upper side of said support legs (14).

5. A worktable according to claim 2, wherein said supporting columns (16, 17) are U-shaped in profile, opening to the outer side, and are provided with fastening holes (26) in both U-shaped portions of said supporting columns, and said supporting columns are covered by at least one cover plate (20).

6. A worktable according to claim 2, wherein said transverse connecting member (18) has a U-shaped profile open toward the top and covered by at least one cover plate (21, 28).

7. A worktable according to claim 6, wherein said cover plates (28) have receptacles (29) sized for receiving mating portions (37) of auxiliary devices.

8. A worktable according to claim 6, wherein said cover plates (21) on said transverse connecting member (18) are arranged at normal working height and said support legs (14) of said one-piece leg members (10) terminate at a given interval below said cover plates (21), said interval determined by the lowest adjustment height of said working surface (22) and the height of said adjustment mechanisms (24) at their lowest adjustment.

9. A worktable according to claim 2, wherein said adjustment mechanisms (24) are fully covered by a bellows, and the operating elements of said adjustment mechanisms are arranged on the underside of said work surface (22) between said adjustment mechanisms.

10. A worktable according to claim 2, characterized by said base frame comprising a closed base unit (40, 50) which is provided with hanger moldings (41, 42, 51, 52) on the vertical edges on at least the front side.

11. A worktable according to claim 10, characterized by said closed base unit (40) extending higher than said working surface (22) adjusted to its highest position and bearing a shelf (44) directed toward said working surface (22) at its upper edge.

12. A worktable according to claim 10, characterized by said closed base unit (50) having a height at least double the worktable height and being provided on one side with a removable, horizontally directed cover plate (55) at working level which covers said transverse connecting member (18) which is U-shaped and open toward said cover plate.

13. A worktable according to claim 10, characterized by the vertical narrow sides of said closed base unit (40, 50), being provided with cover plates (20) at least up to working level, which cover U-shaped members forming said support columns (16, 17) open toward said cover plates.

14. A worktable according to claim 10, characterized by at least one shelf (45, 53) having hangers connectible with said hanger moldings (42, 42, 51, 52).

15. A worktable according to claim 10, characterized by said leg members (10) having hangers connectible with said hanger moldings (41, 42, 51, 52).

16. A worktable according to claim 2, wherein said unitary base frame (15) and work surfaces (22) have different widths which are matched to each other.

17. A worktable according to claim 2 additionally adjustable in inclination.

* * * * *